US005820124A

United States Patent [19]

Lawrence

[11] Patent Number: 5,820,124

[45] Date of Patent: Oct. 13, 1998

[54] DISPLAY PUZZLE

[76] Inventor: Richard Harry Lawrence, 1 Albion Villas, Cliff Street, Cheddar, Somerset, BS27 3PN, Great Britain

[21] Appl. No.: 817,621

[22] PCT Filed: Oct. 27, 1995

[86] PCT No.: PCT/GB95/02544

§ 371 Date: Apr. 24, 1997

§ 102(e) Date: Apr. 24, 1997

[87] PCT Pub. No.: WO96/13311

PCT Pub. Date: May 9, 1996

[30] Foreign Application Priority Data

Oct. 29, 1994 [GB] United Kingdom ..... 9421822

[51] Int. Cl.[6] ..... A63F 9/10

[52] U.S. Cl. ..... 273/157 R

[58] Field of Search ..... 273/157 R, 156, 273/153 R

[56] References Cited

U.S. PATENT DOCUMENTS

| | | | |
|---|---|---|---|
| 763,064 | 6/1904 | Mercer | 273/157 R |
| 2,957,251 | 10/1960 | Nystad et al. | 273/157 R |
| 3,242,594 | 3/1966 | Smith | 273/157 R |
| 3,305,945 | 2/1967 | Crawford et al. | 273/156 |
| 3,909,003 | 9/1975 | Rabinovich | 273/157 R |
| 4,051,607 | 10/1977 | Sullivan . | |
| 4,687,202 | 8/1987 | Palma | 273/157 R |
| 4,815,742 | 3/1989 | Augustine | 273/157 R |
| 5,362,054 | 11/1994 | Ashemimry | 273/157 R |

FOREIGN PATENT DOCUMENTS

| | | |
|---|---|---|
| 941847 | 8/1961 | United Kingdom . |
| 1493934 | 3/1974 | United Kingdom . |
| 2139512 | 5/1984 | United Kingdom . |
| 2214824 | 2/1988 | United Kingdom . |
| 2210800 | 9/1988 | United Kingdom . |
| 2231808 | 5/1990 | United Kingdom . |
| 2249484 | 11/1990 | United Kingdom . |
| 2265836 | 4/1992 | United Kingdom . |

*Primary Examiner*—Steven B. Wong

*Attorney, Agent, or Firm*—Gifford, Krass, Groh, Sprinkle, Patmore, Anderson & Citkowski, P.C.

[57] ABSTRACT

A display puzzle comprising a support and a plurality of puzzle elements, the support and the elements having mutually-interengageable, releasable attachment members such that the elements are attachable to the support in at least on predetermined display arrangement for support thereby, wherein the support is so formed and each puzzle element has an edge portion so formed that, when each element is attached to the support, the edge portion is spaced from the support and can be pressed manually against the support to pivot the respective element relative to the support to release it therefrom, the releasable attachment members being sufficiently effective to hold the puzzle elements in position against inadvertent movement even when the puzzle is arrayed in a vertical position.

13 Claims, 5 Drawing Sheets

DISPLAY PUZZLE

The present invention relates to a display puzzle.

The assembly of picture puzzles is a well known and popular leisure activity and, in general, involves the interengagement of a plurality of small picture elements to complete a given picture. Once finished, the picture is normally broken up fairly quickly and returned to a box for storage. In between construction periods, the pieces are thus "idle", and do not provide any entertainment, not even, for example, as part of the decor of a house.

In order to make use of a completed puzzle, particularly if the picture created is very attractive, it is known to glue the assembled pieces to a backing board so that the picture can be hung on a wall and enjoyed as a decoration. This has the disadvantage, of course, that the play aspect of the puzzle is lost as the pieces can no longer be taken apart for reassembly.

Various display devices are also known in which pieces are releasably attachable to a support so that a picture or like display can be built up and then used as a decorative item but in which the pieces are readily removable so that the, or a different, assembly can subsequently be made. Examples of such devices are disclosed in GB-A-2211103, U.S. Pat. No. 4,993,984, U.S. Pat. No. 3,242,594 and DE-A-1810916.

The object of the present invention is to provide an alternative form of display puzzle which, once completed, can be used as a decoration but which can readily be broken down into its constituent parts when required for play. In particular, the present invention seeks to provide such a puzzle in which pieces are readily removable from a support even when they are closely juxtaposed on the support and cannot readily be gripped manually for their removal.

Accordingly, the present invention provides a display puzzle comprising a support and a plurality of puzzle elements, the support and the elements having mutually-interengageable, releasable attachment means such that the elements are attachable to the support in at least one predetermined display arrangement for support thereby characterised in that the puzzle elements and the support are so formed that, when each element is assembled on the support in a display position, an edge portion of the element is spaced from the support and can be pressed manually against the support to pivot the remaining portion of the element away from the support to release the element therefrom.

The support of the display puzzle may be of any shape or size depending on the nature of the completed display, its size and shape, the size and shape of the puzzle elements and the nature of the attachment means. For example the support may comprise a frame engageable by a relatively small number of simple elements, such as are required in a puzzle for a young child. In preferred embodiments of the invention, however, the support comprises a backing sheet, preferably substantially rigid, against which the puzzle elements are located to build up a picture or display, which may, but need not necessarily, be flat. Images may be formed on the puzzle elements in any known way such as by printing, either directly onto the element or onto a layer to be attached thereto, and encapsulated with a transparent material protection.

The backing sheet and the puzzle elements may interengage in any convenient manner. For example, either the backing sheet or the elements may have a release adhesive on the face intended to contact the elements or the sheet respectively. Alternatively the surfaces of the backing sheet and the elements which are to come into mutual contact may be faced with the two parts of a multi-hook fastener, such as VELCRO (Registered TM). As a further alternative, the elements may be magnetically attracted to the backing sheet.

In preferred embodiments, the backing sheet and the elements have mutually snap-engageable attachment formations. These may be arranged and/or shaped so that each element can be located in only one position on the backing sheet or in a plurality of different positions. The snap-engageable element may comprise a projection upstanding from the backing sheet engageable in a cooperating recess in a puzzle element or vice versa. Alternatively each puzzle element may be a snap-fit in a cooperating seat in a backing support, or may simply be a tight fit rather than a snap-fit in such a seat.

The puzzle elements may have any peripheral shape whatsoever provided they can be located adjacent each other on the backing sheet to create a display: they may, for example, be in the form of jigsaw-like pieces having fully-interlocking contours or they may have simple shapes, such as squares, so that the completed display relies totally on the interengagement of the elements with the backing sheet to keep the puzzle together. Moreover the puzzle elements may be locatable on the backing sheet in only one arrangement to form a display, as is usual with pictures created from interlocking jigsaw pieces. Alternatively they may be arrangeable to create a plurality of different displays, whether preconceived by the manufacturer of the puzzle and determined, for example, by the shape and/or colouring of the puzzle elements, or determined by the choice and imagination of the player.

Whatever form of interengagement is provided between the backing sheet and the elements, the latter must be readily releasable from the backing, this being achievable by the pivoting of the element on the support which will raise one portion so that it can be grasped.

In a preferred embodiment of the invention, the elements are rendered readily releasable from the backing support by means of detents formed in the backing surface, each detent being of such a shape and located in such a position that an edge portion of a respective element superimposed on the backing sheet in that position can be depressed manually into the detent so as to pivot the remaining portion of the element away from the backing sheet so that it can be grasped and removed.

Alternatively, an edge portion of each element may have a bevelled or recessed under surface to allow that portion to be depressed against the backing sheet and cause the remaining portion to be raised from the sheet. It may be necessary to shape adjoining edges of adjacent elements in such a way that two elements do not interfere with each other during such pivoting movement.

In addition to the mutual attachment means of the puzzle elements and the backing sheet, other mutually-cooperating locating members may be provided for locating the elements in selected positions on the backing sheet during assembly of the puzzle.

The display puzzle of the invention may include a frame for the completed display, either as part of or separately from the backing sheet for the puzzle elements, together with means for mounting the completed display on a wall or for supporting it on an upstanding orientation on a flat surface. It may further include a transparent sheet of, for example, glass or perspex engageable with the frame to cover the completed display; such a sheet may be houseable in a compartment in the support, for example behind a face on which the puzzle pieces are assembled in use, during assembly of the display. The support may also have a compartment for housing the loose puzzle elements before their assembly to form the display.

The support and the puzzle elements of the invention may be made from any material suitable for their construction according to the type of engagement means employed. They may thus be of wood, card, metal or plastics materials, the latter being preferred for simplicity of manufacture.

Two embodiments of the invention will now be more particularly described, by way of example, with reference to the accompanying drawings, in which.

Figure 1:
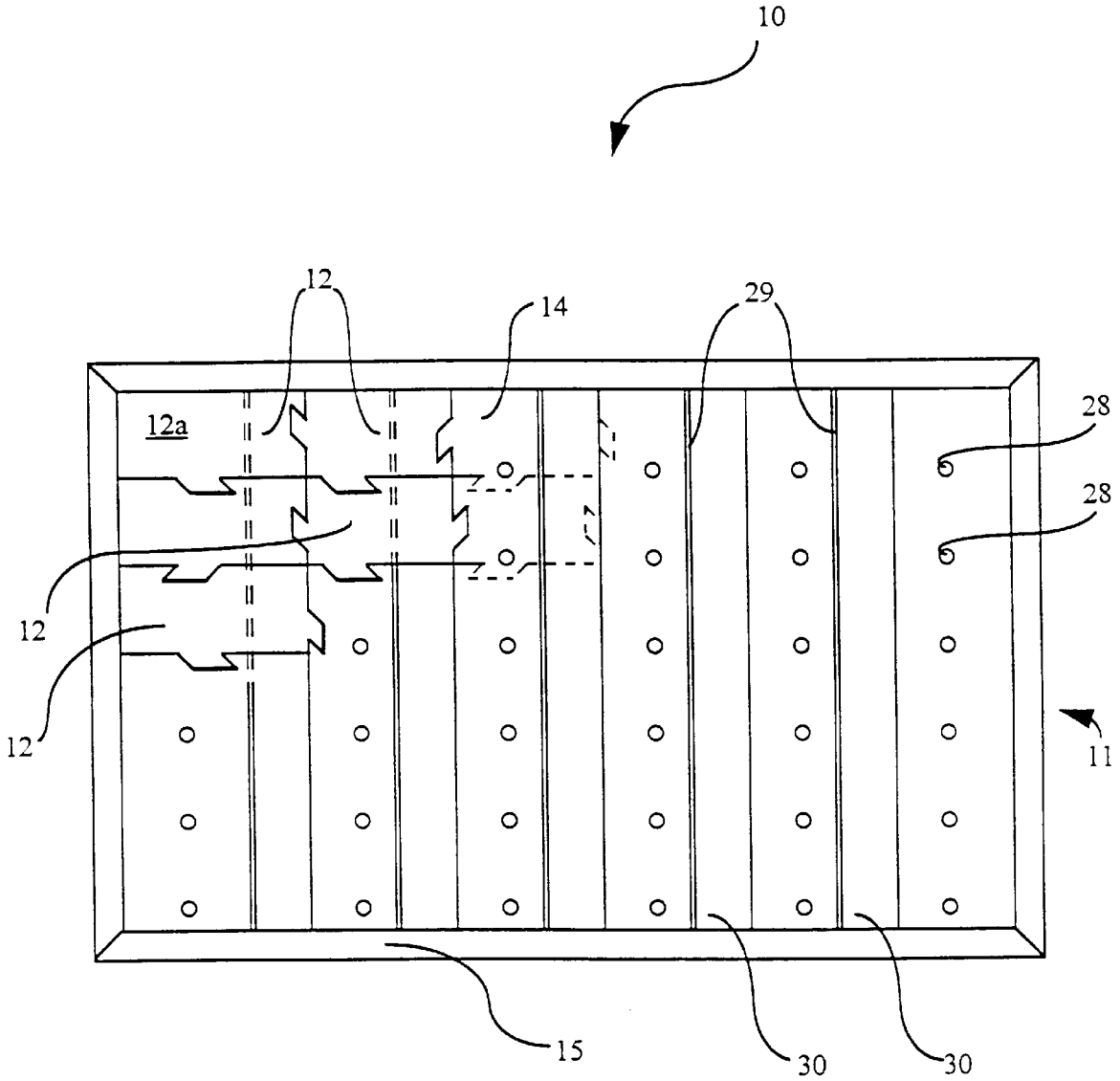
FIG. 1 is a plan view of a display puzzle of the invention with some of the puzzle elements assembled on a supporting container.
Figure 2:
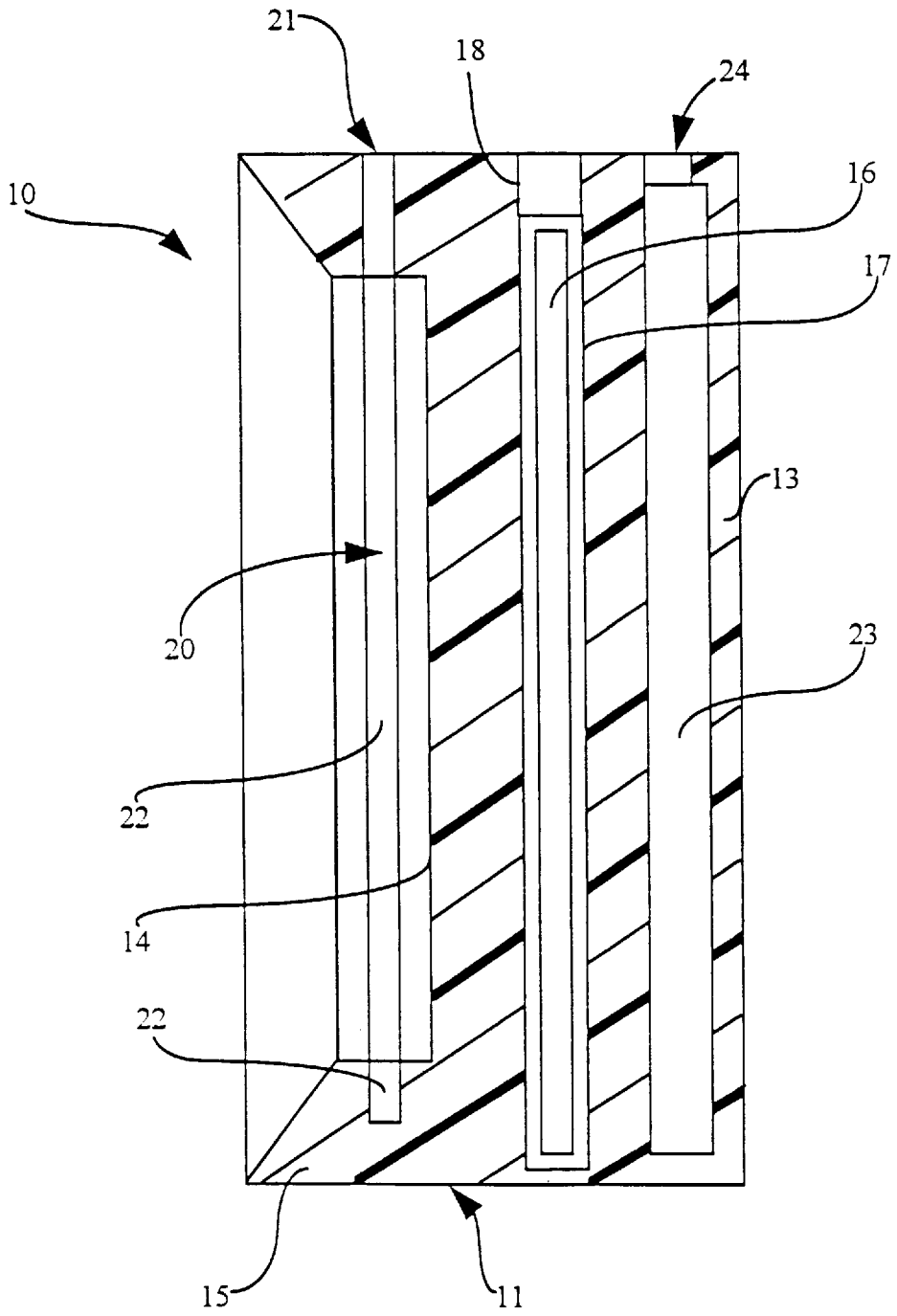
FIG. 2 is a sectional view of the supporting container taken on the line II—II of FIG. 1, without the puzzle elements.

With reference to FIGS. 1 and 2 of the drawings, a display puzzle is shown generally indicated 10 and comprises a supporting container generally indicated 11 and a plurality of substantially flat puzzle pieces, each indicated 12, only some of which are shown.

The container 11 comprises a thin box-like body 13 with a rectangular display face 14 surrounded by a rectangular frame 15 which projects forwardly of the display face 14. The puzzle pieces 12 can be attached to the display face 14 in a manner described more fully below with reference to FIGS. 3 and 4 with their display faces, indicated 12*a*, combining to form a picture. When the pieces 12 are assembled in this manner, the frame 15 surrounds the picture and the display puzzle 10 as a whole can be hung on a wall in the usual manner for pictures, or otherwise displayed as an ornament.

For use as an ornament, the puzzle further includes a transparent sheet 16 which may be glass or perspex for example, and which can be housed in a first storage compartment 17 behind, and parallel to, the display face 14. The sheet 16 is a sliding fit in the compartment 17 through an opening 18 in the upper side of the container 11 which is closable by a lid not shown. When the picture is completed, the sheet 16 can be removed from the storage compartment 17 and slid into a cooperating seat 20 formed in the frame 15 of the container 11 so that it is in front of the completed picture. The seat 20 is defined by a slot 21 in the upper side of the frame, through which the sheet 16 is inserted, and channels 22 in the sides and bottom of the frame 15.

The container 11 has a further storage compartment indicated 23 behind the first storage compartment 17. This further compartment 23 is intended to contain the puzzle pieces 12 when they are not assembled on the display face 14, for example while the display puzzle is on sale. Access to the further compartment 23 is also gained through a slot, indicated 24, in the upper side of the container 11. The slot 24 is closable by a lid which may comprise part of the lid for the first compartment 17.

Figure 3:
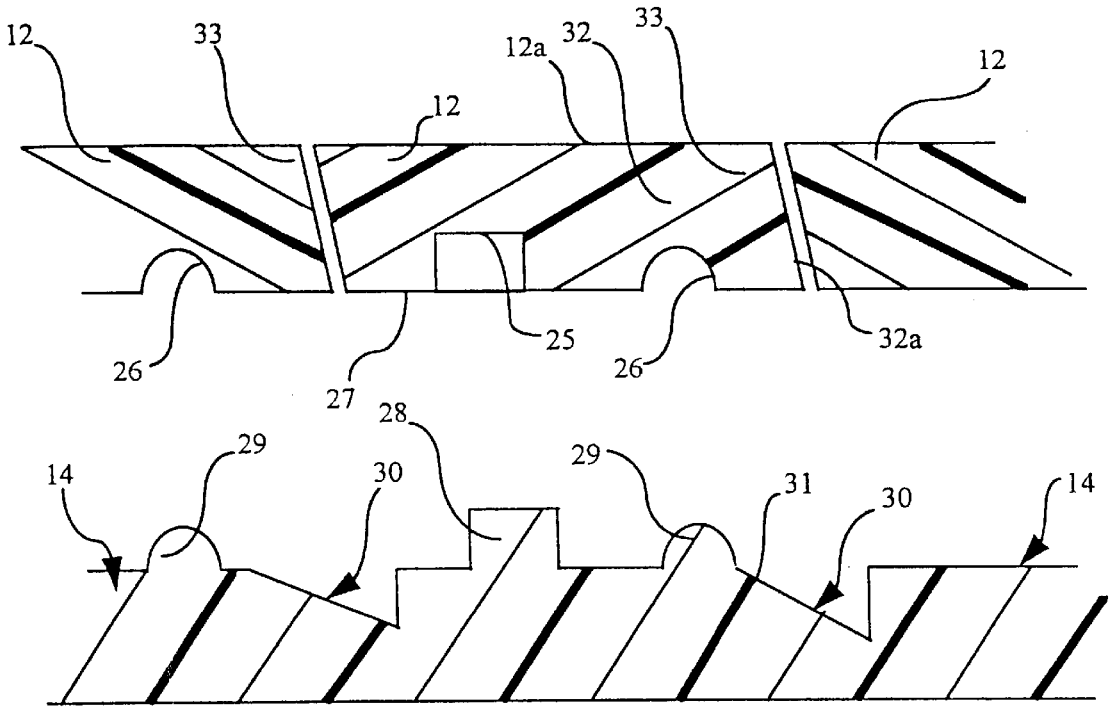
FIG. 3 is an enlarged sectional view of a puzzle element located adjacent a face of the container of FIG. 1, taken in a plane perpendicular to that of FIG. 2.
Figure 4:
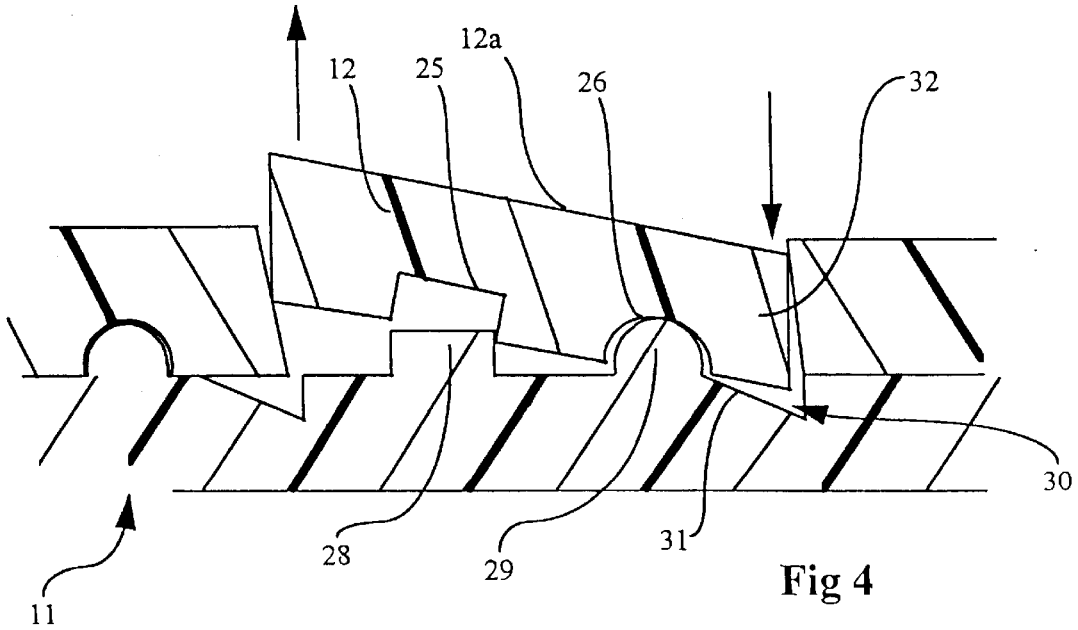
FIG. 4 is a view similar to FIG. 3 showing the element being removed from the face of the supporting container.

Reference will now be made to FIGS. 2, 3 and 4 of the drawings. In order to allow the pieces 12 to be located on, and attached to the display face 14, each piece 12 has two cavities 25, 26 in its face 27 opposite its display face 12*a*. The first cavity 25 is a locating member and is in the form of a cylindrical blind hole while the second cavity 26 is an engagement member and is in the form of an elongate channel with a cross-section of circular form, extending through slightly more than a semi-circle.

To cooperate with the cavities 25, 26 of the pieces 12, the display face 14 of the supporting container 11 has a plurality of cylindrical projections 28 which are each a close fit in a blind hole 25 and a plurality of parallel, equispaced, upstanding ridges 29 having cross-sections which match those of the puzzle-piece channels 26. The projections 28 are shown in a regular rectangular array on the face 14, being arranged in rows parallel to the ridges 29 and lines perpendicular thereto.

In the arrangement shown, any one piece 12 may be located with its blind hole 25 on any projection 28 and its channel 26 engaged with the adjacent ridge 29. The projections 28 and ridges 29 and the cavities 25, 26 could however be shaped and/or arranged so that only a selected one, or a selected group, of the pieces 12 could be fitted in selected positions on the display face 14.

The pieces 12 could all be the same shape and could be distinguished from each other only by surface decoration but the pieces shown in FIG. 2, although being generally rectangular and flat, have varying projections and recesses on respective edges for interlocking with corresponding recesses and projections of adjacent pieces, in the manner of interlocking jigsaw pieces. The pieces 12 can be assembled on the display face 14 so as to cover it completely in the manner of a jigsaw puzzle, the pieces 12 preferably having surface decoration such as to complete a picture when they are assembled correctly. The surface decoration, shaping of the pieces and arrangement of the cavities 25, 26 and projections 28 and ridges 29 may be such that the pieces could be assembled in several different arrangements to form different pictures or patterns. The pieces 12 may also have generally rounded outlines rather than the angular outlines shown.

With reference now particularly to FIGS. 3 and 4, FIG. 3 shows a piece 12 in position over a projection 28 and ridge 29 on the display surface 14 ready to be fitted onto it. The piece is simply a press fit, being made of a plastics material which can yield resiliently to allow the insertion of the ridge 29 in the channel 26. If the display face 14 and opposing face of the piece 12 were otherwise flat, however, it would be difficult to remove the fully assembled pieces 12 from the display face 14 for re-use. The display face 14 is therefore formed with a wedge shaped channel 30 alongside each ridge 29, on the opposite side from the adjacent projection 28, the bottom 31 of each channel 30 sloping downwards from ridge 29 into the body 13 of the container 11. When it is wished to remove a piece 12 from the surface 14, its edge portion overlying the respective channel 30 can be depressed into the channel, as shown in FIG. 4, so that the remaining part of the piece pivots up, away from the surface 14 so that it can be grasped by the user and removed. In order to facilitate this pivoting, particularly in the case of pieces 12 which fit very well together, touching edge surfaces of adjacent pieces 12 are bevelled in opposite directions. As shown in FIG. 4, that edge portion 32 of the piece 12 which is depressed into the channel 30 during removal is bevelled so that its inclined surface 32*a* faces away from the supporting surface 14, while the opposing bevelled face 33 of the adjacent piece faces downwardly. This allows the edge portion 32 to move into the channel 30 without interference from the adjacent piece 12.

Although the embodiment described has both locating projections 28 and attachment ridges 29, the projections 28 are not essential; they merely stop the pieces 12 from sliding along the ridges 29. Combined locating and attachment knobs could alternatively be provided as shown in the embodiment of FIGS. 5 to 8 described below.

With reference to FIGS. 5 to 8, part of an alternative embodiment of a display puzzle is shown in which features similar to those of the embodiment of FIGS. 1 to 4 are indicated by the same reference numerals increased by 100 and will not be described again. More particularly the puzzle elements 112 and supporting container 111 differ from those of FIGS. 1 to 4 only in the means of attachment of the elements 112 to the display face 114. For this purpose the display face 114 has an array of resiliently-deformable upstanding projections 40, only one of which is shown in the drawings, each engageable with a cooperating recess 41 in the under face 127 of a display element 112. The projections 40 may be arranged in any manner on the display face 114 so as to cooperate with respective ones of the display elements 112 such that all the elements 112 can be located on the display face 114 to form a picture. The FIGS. 5 to 8 the scale and inclination of various features are exaggerated for clarity of illustration.

Figure 5:
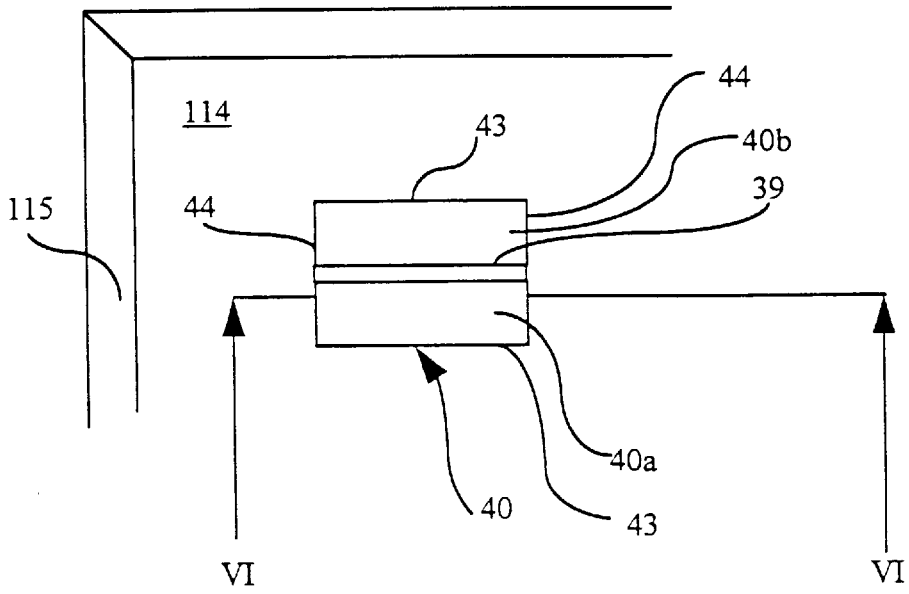
FIG. 5 is a plan view of part of a supporting container of a second embodiment of the invention.

Returning to the projections 40, it will be seen from FIG. 5 that these are generally rectangular in plan with two opposite longer side faces 43 and two shorter side faces 44. Each projection 40 is divided into two parts 40*a*, 40*b* by a central slot 39 which extends generally parallel to the two longer side faces 43. From FIG. 6 it will be seen that the shorter side faces 44 are generally planar and, although almost perpendicular to the display face 114, are very slightly inclined to each other.

Figure 8:
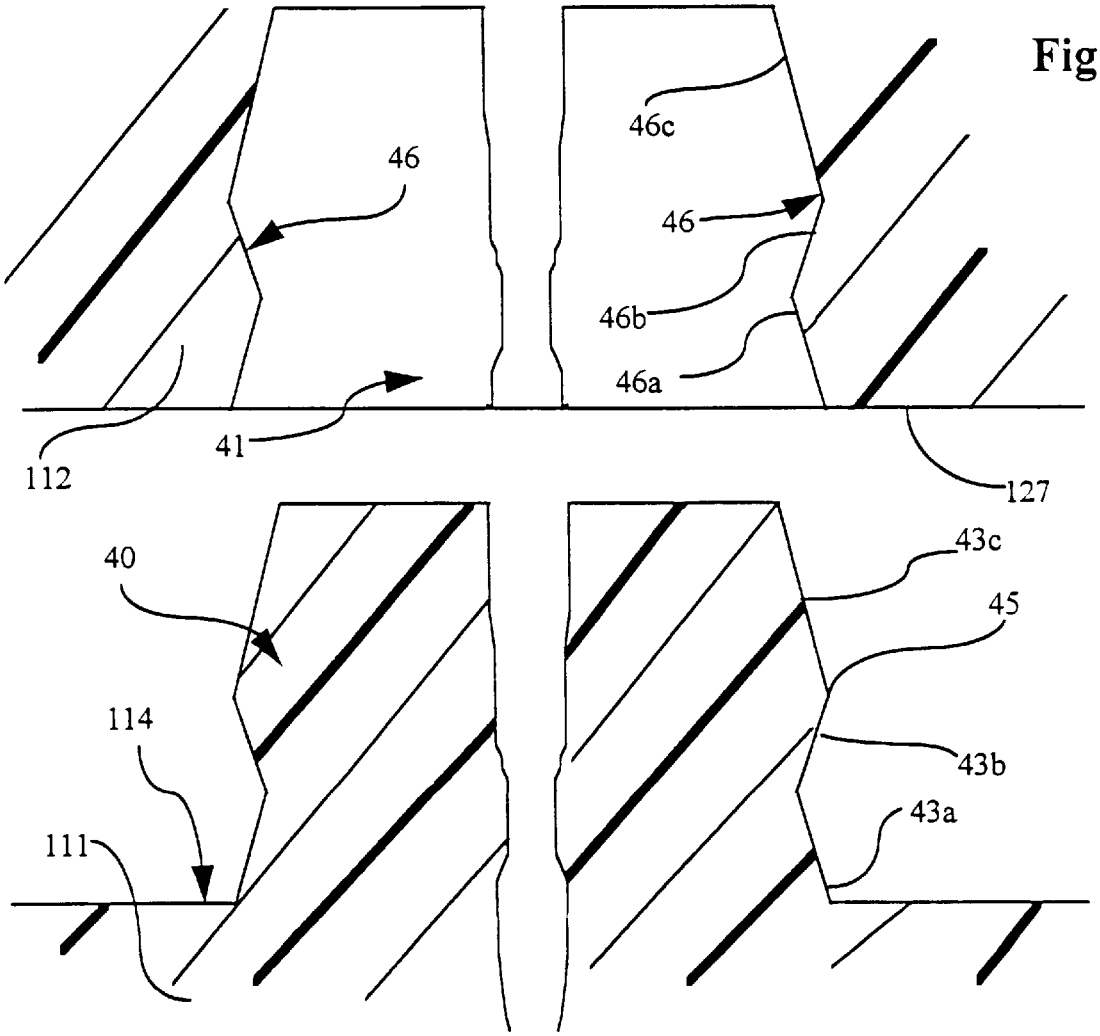
FIG. 8 is an enlarged sectional view of part of FIG. 6.

The longer side faces 43 are shown best in FIG. 8 where it can be seen that they are divided longitudinally into three portions of which a base portion 43*a*, adjoining the display face 114, is inclined towards the opposite face 43. Each base portion 43*a* is then joined to an intermediate face portion 43*b* which is inclined away from the opposite side face 43 and terminates at a shoulder 45 where it joins the third side face portion 43*c*. This again is inclined towards the opposite side face 45.

The recesses 41 in the puzzle elements 112 may have identical profiles to those of the projections 40 as shown in FIG. 8 but the profiles of their shorter side faces 46 may be simpler than those of the projections 40. In the profile of FIG. 8, the recess has face portions 46*a*, 46*b*, 46*c* corresponding to the faces 43*a*, 43*b*, 43*c* of the projection 40. What is important is that each puzzle element 112 can be fitted on to a projection 40 with the shorter side faces 46 of the recess 41 engaging the shoulders 45 of the corresponding projection 40 to press the two parts 40*a*, 40*b* together. The element 112 may then be retained against the display face 14 by the resilient pressure of the parts 40*a*, 40*b* against the faces 46 of its recess but, in the arrangement of FIG. 4, the shoulder formed by the inclined faces 46*a*, 46*b* snaps into the recess defined by the projection faces 43*b*, 43*a* to retain the element 112 in position.

Figure 6:
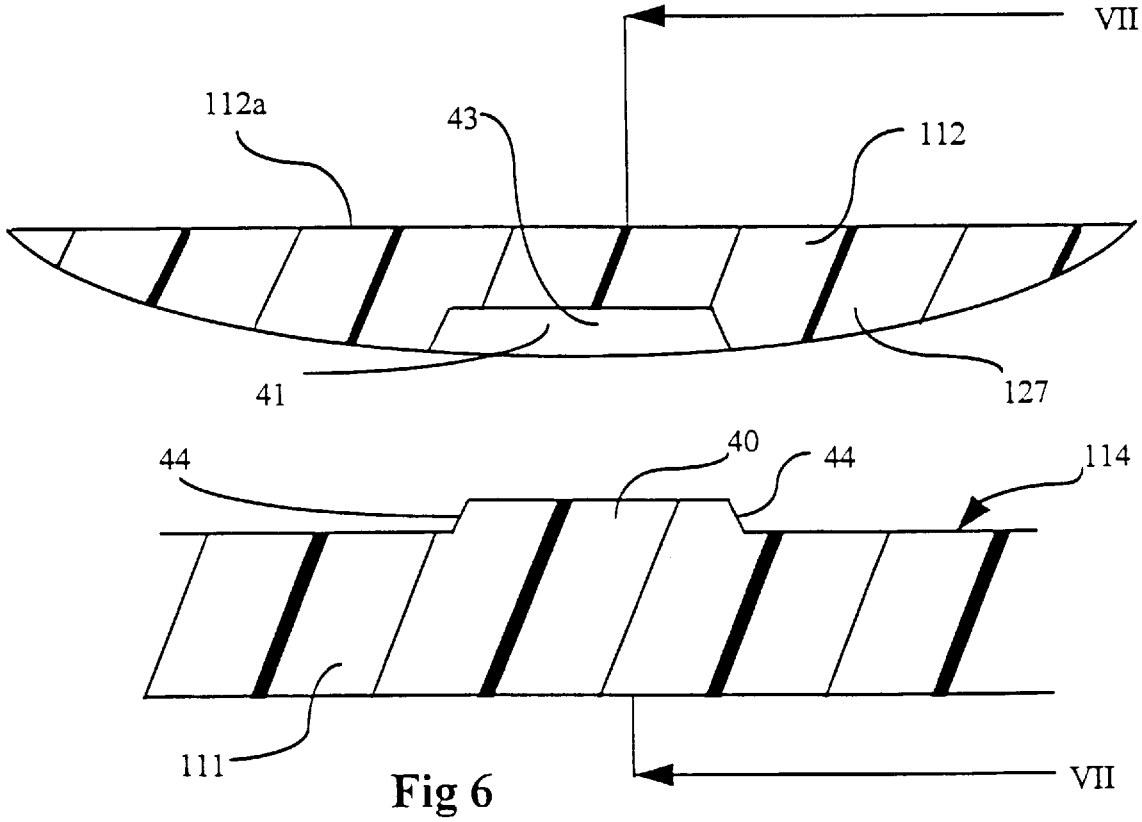
FIG. 6 is a sectional view taken on the line VI—VI of FIG. 5 and also showing a puzzle element of the second embodiment of the invention in section.
Figure 7:
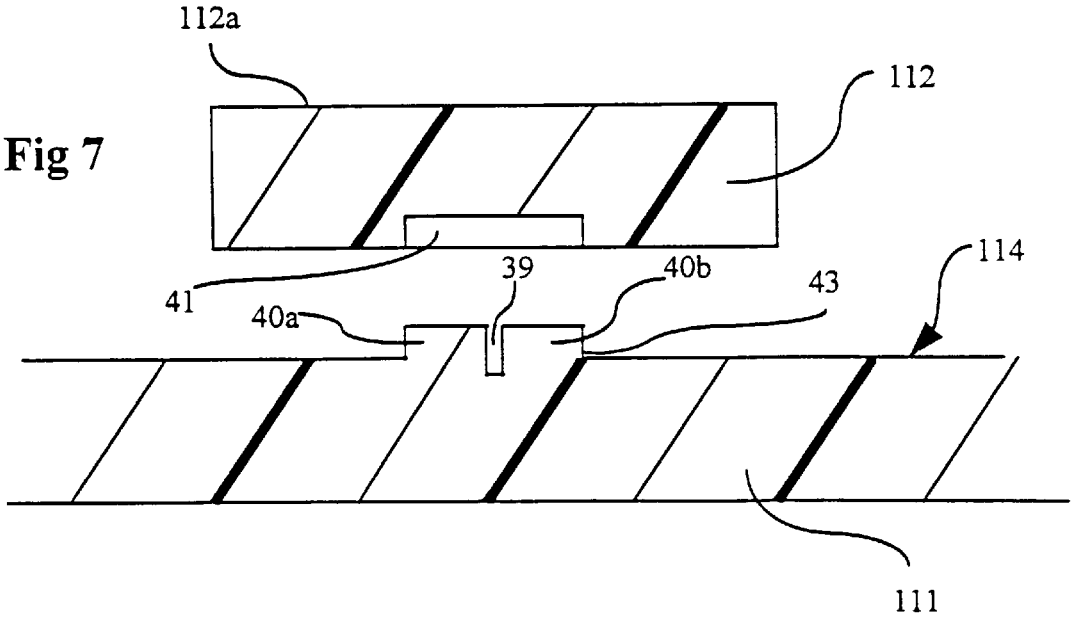
FIG. 7 is a sectional view taken on the line VII—VII of FIG. 6.

A final feature of the element 112 of FIGS. 5 to 7 is the shaping of its under surface 127. Instead of this being generally flat, as in the embodiment of FIGS. 1 to 4, it has a slight convex curvature towards the display face 114, the curvature being about only one axis parallel to the shorter sides of the recess 41.

The curvature of the under surface 127 allows one end of the display element 112 to be depressed against the display face 114 to disengage the recess 41 from its retaining projection 40 in a manner similar to that explained for the element 12 of FIGS. 1 to 4.

It will be appreciated that the resiliently deformable projection 40 could be round or otherwise shaped in plan and, if made of suitable material, need not have a slot 39 to allow its deformation. Similarly, the face 127 could have a planar taper or be spherically curved. Moreover the positioning and/or shaping of the projection 40 and its cooperating recess 41 on the support 111 and element 112 could be reversed while the display face 114 could have convexly curved raised portions serving a similar purpose to the curved surface 127 of the element 112, this surface 127 being flat and parallel to its display face 112*a*.

What is claimed is:

1. A display puzzle comprising a support and a plurality of puzzle elements, said support and said elements having mutually-interengageable, releasable attachment means whereby said elements are attachable to said support in at least one predetermined display arrangement for support thereby, wherein said support is so formed and each said puzzle element has an edge portion so formed that, when each said element is attached to said support, said edge portion is spaced from said support and can be pressed manually against said support to pivot the respective said element relative to said support to release it therefrom, said releasable attachment means being sufficiently effective to hold said puzzle elements in position against inadvertent movement even when said puzzle is arrayed in a vertical position.

2. The display puzzle as claimed in claim 1, wherein said support comprises a substantially rigid backing sheet defining a generally planar display face on which said puzzle elements can be arranged in said at least one display arrangement.

3. The display puzzle as claimed in claim 1 wherein said support and said puzzle elements define mutually-engageable projections and recesses constituting said attachment means.

4. The display puzzle as claimed in claim 3, wherein said projections and recesses are mutually snap-engageable.

5. The display puzzle as claimed in claim 1, wherein said support defines a plurality of positions each having a said attachment means capable of releasably receiving a said puzzle element and each said puzzle element is attachable to said support at any one of said positions.

6. The display puzzle as claimed in claim 5, wherein said support has a display face which defines said plurality of positions and wherein each said puzzle element is locatable in isolation at any one of said positions but said puzzle elements have mutually engaging peripheries of such shapes that said elements are attachable to said support so as completely to cover said display face only in a limited number of display arrangements including said at least one display arrangement.

7. The display puzzle as claimed in claim 6, wherein said puzzle elements are fully interlocking jigsaw-like elements.

8. The display puzzle as claimed in claim 1, wherein said support defines a storage compartment for housing said puzzle elements when not in said display arrangement.

9. The display puzzle as claimed in claim 1, further including means for supporting said support in a display orientation in which said puzzle elements attached to said support in said at least one display arrangement are displayed for viewing.

10. The display puzzle as claimed in claim 9, wherein said support defines a display face and said display puzzle includes a frame surrounding and projecting forwardly of said display face when said support is supported in said display orientation.

11. The display puzzle as claimed in claim 10, wherein said support defines a seat surrounding said display face, said display puzzle includes a sheet of transparent material engageable with said seat in such a position as to be located in front of said display elements in said display arrangement and said support further defines a storage compartment capable of housing said sheet of transparent material when not engaged with said seat.

12. A display puzzle comprising a support and a plurality of puzzle elements, said support and said elements having mutually-interengageable, releasable attachment means whereby said elements are attachable to said support in at least one predetermined display arrangement for support thereby, wherein said support includes a plurality of channels formed therein and each said puzzle element has an edge portion so formed that, when each said element is attached to said support, said edge portion is spaced from a selected said channel in said support and can be pressed manually against said support to pivot the respective said element relative to said support to release it therefrom, said releasable attachment means being sufficiently effective to hold said puzzle elements in position against inadvertent movement even when said puzzle is arrayed in a vertical position.

13. The display puzzle puzzle comprising a support and a plurality of puzzle elements, said support and said elements having mutually-interengageable, releasable attachment means whereby said elements are attachable to said support in at least one predetermined display arrangement for support thereby, wherein said support is so formed and each said puzzle element has a curved surface portion so formed that, when each said element is attached to said support, said curved surface edge portion is spaced from said support and can be pressed manually against said support to pivot the respective said element relative to said support to release it therefrom, said releasable attachment means being sufficiently effective to hold said puzzle elements in position against inadvertent movement even when said puzzle is arrayed in a vertical position.

* * * * *